US010538934B2

(12) United States Patent
Buonpane et al.

(10) Patent No.: US 10,538,934 B2
(45) Date of Patent: Jan. 21, 2020

(54) PROTECTION PANEL SYSTEMS AND METHODS

(71) Applicants: Gerard Buonpane, Ship Bottom, NJ (US); Diane Buonpane, Ship Bottom, NJ (US)

(72) Inventors: Gerard Buonpane, Ship Bottom, NJ (US); Diane Buonpane, Ship Bottom, NJ (US)

( * ) Notice: Subject to any disclaimer, the term of this patent is extended or adjusted under 35 U.S.C. 154(b) by 0 days.

(21) Appl. No.: 16/258,868

(22) Filed: Jan. 28, 2019

(65) Prior Publication Data

US 2019/0242149 A1 Aug. 8, 2019

Related U.S. Application Data

(63) Continuation-in-part of application No. 15/886,939, filed on Feb. 2, 2018, now Pat. No. 10,081,979.

(51) Int. Cl.
*E04H 9/14* (2006.01)
*E06B 9/04* (2006.01)
(Continued)

(52) U.S. Cl.
CPC ..... *E04H 9/14* (2013.01); *E06B 3/26* (2013.01); *E06B 9/02* (2013.01); *E06B 9/04* (2013.01);
(Continued)

(58) Field of Classification Search
CPC ..... E04H 9/14; E06B 3/26; E06B 9/92; E06B 9/04; E06B 2009/005; E06B 3/5063;
(Continued)

(56) References Cited

U.S. PATENT DOCUMENTS 2,598,610 A 5/1952 Satz et al.
4,198,796 A 4/1980 Foster
(Continued)

FOREIGN PATENT DOCUMENTS

EP 1467041 A1 * 10/2004 ..... E04C 2/54
EP 2789784 B1 * 5/2015 ..... E06B 5/12
EP 3112576 A1 * 1/2017 ..... E06B 5/12

*Primary Examiner* — Adriana Figueroa
(74) *Attorney, Agent, or Firm* — Clements Bernard PLLC; Christopher L. Bernard

(57) ABSTRACT

Disclosed herein are building opening protection panel systems and methods for windows, doors, and other portals that may be vulnerable to damage, such as external projectiles or wind and debris forces active during storms. The protection panel systems and methods may include a lightweight multi-wall plastic panel housed within a lightweight solid plastic shell, which can be inserted into the building opening to prevent external wind pressures and other elements from infiltrating and/or causing damage to the building and its interior contents. The multi-wall plastic panel may include through-holes and/or other apertures for threading anchoring straps. The multi-wall plastic panel threaded with straps may then be inserted and affixed within the solid plastic shell to provide a wind proof exterior face. The multi-wall plastic panel within the solid plastic shell may then be fastened to a window sash, door, and/or other anchoring structure within the building opening using the straps.

15 Claims, 7 Drawing Sheets

(51) Int. Cl.

| | |
|---|---|
| ***E06B 9/92*** | (2006.01) |
| ***E06B 3/26*** | (2006.01) |
| ***E06B 9/02*** | (2006.01) |
| *E06B 9/00* | (2006.01) |

(52) U.S. Cl.
CPC ..... *E06B 9/92* (2013.01); *E05Y 2900/132* (2013.01); *E05Y 2900/148* (2013.01); *E06B 2009/005* (2013.01)

(58) Field of Classification Search
CPC ..... E06B 3/4415; E06B 2003/4484; E05Y 2900/132; E05Y 2900/148
See application file for complete search history.

(56) References Cited

U.S. PATENT DOCUMENTS

| | | | | | |
|---|---|---|---|---|---|
| 4,685,261 | A | | 8/1987 | Seaquist | |
| 5,228,238 | A | * | 7/1993 | Fenkell | E06B 3/38 49/125 |
| 5,457,921 | A | | 10/1995 | Kostrzecha | |
| 5,787,642 | A | * | 8/1998 | Coyle | E06B 9/01 49/50 |
| 5,852,903 | A | | 12/1998 | Astrizky | |
| 5,918,430 | A | * | 7/1999 | Rowland | E06B 3/28 244/129.3 |
| 6,079,168 | A | | 6/2000 | Shaver | |
| 6,161,605 | A | * | 12/2000 | Pena | E06B 9/0638 160/105 |
| 6,189,264 | B1 | | 2/2001 | DiVeroli | |
| 6,314,689 | B1 | | 11/2001 | Hughes | |
| 6,615,555 | B2 | | 9/2003 | Madden | |
| 6,898,907 | B2 | | 5/2005 | Diamond | |
| 6,907,710 | B2 | | 6/2005 | Trundle | |
| 7,793,581 | B2 | * | 9/2010 | Erskine | B32B 17/10036 89/36.04 |
| 7,802,606 | B2 | | 9/2010 | Landry | |
| 7,805,898 | B1 | | 10/2010 | Everitt | |
| 7,975,440 | B2 | | 7/2011 | Motosko et al. | |
| 7,997,036 | B1 | | 8/2011 | Motosko et al. | |
| 8,109,060 | B1 | | 2/2012 | Motosko | |
| 8,281,841 | B2 | | 10/2012 | Landry | |
| 8,291,657 | B2 | | 10/2012 | White | |
| 8,402,693 | B1 | | 3/2013 | Trefzer | |
| 8,528,254 | B1 | | 9/2013 | Johnston | |
| 9,027,280 | B2 | | 5/2015 | Huddleston | |
| 9,027,293 | B1 | * | 5/2015 | Scott | E06B 9/02 428/99 |
| 9,752,373 | B2 | | 9/2017 | Pardue et al. | |
| 2003/0159372 | A1 | | 8/2003 | Motro | |
| 2005/0193651 | A1 | * | 9/2005 | Kirk | E06B 9/04 52/202 |
| 2006/0179737 | A1 | | 8/2006 | Trundle | |
| 2007/0107856 | A1 | * | 5/2007 | Cordova | E06B 9/02 160/183 |
| 2007/0113494 | A1 | | 5/2007 | Kim et al. | |
| 2007/0151174 | A1 | * | 7/2007 | Osborne | E06B 9/02 52/171.1 |
| 2007/0175117 | A1 | | 8/2007 | Brown | |
| 2007/0193137 | A1 | * | 8/2007 | DeBoth | E06B 9/02 52/202 |
| 2009/0151276 | A1 | * | 6/2009 | Debes, Jr. | E06B 9/02 52/203 |
| 2010/0064606 | A1 | | 3/2010 | Devalapura et al. | |
| 2010/0281783 | A1 | * | 11/2010 | Harrington | E04H 9/14 52/2.23 |
| 2011/0010997 | A1 | | 1/2011 | Kislov | |
| 2014/0367893 | A1 | | 12/2014 | Motosko et al. | |
| 2015/0090411 | A1 | | 4/2015 | Pyles et al. | |
| 2016/0145934 | A1 | * | 5/2016 | Trott | E06B 5/11 52/203 |
| 2016/0214307 | A1 | | 7/2016 | Motosko et al. | |

* cited by examiner

PROTECTION PANEL SYSTEMS AND METHODS

FIELD OF THE DISCLOSURE

The present disclosure relates generally to systems and methods of protecting homes and buildings from storm or other damage. More specifically, the present disclosure relates to window, door, and other portal protection panels that may be used during storms and major weather events, including hurricanes, tornadoes, and high winds. The protection panel systems may also be used for protection from external debris and projectiles.

BACKGROUND OF THE DISCLOSURE

Hurricanes and other storms with winds around 150 mph, for example, may hit coastlines and inland areas, devastating homes and other buildings. Debris carried by storm winds may impact and shatter windows, doors, and/or other building portals, causing severe external damage and allowing further interior water and other damage from wind driven rain and intrusions. During a storm and/or high winds, windows, doors, and other portals are the most vulnerable points in a building and may fail due to external and internal wind pressures. External positive wind pressure (outside to inside) may cause windows, doors, and other portals to shatter and pressurize the building, which then allows internal negative wind pressure (inside to outside) to push on walls and roof systems, which may cause the interior walls and roofs to become compromised and eventually fail or collapse, resulting in a total loss of contents, as shown in FIG. 1. Therefore, protecting the windows, doors, and other portals in a building, as the weakest entry points, is vital for minimizing loss potential.

While conventional plywood may be installed over windows, doors, and/or other building portals to shield the building from an oncoming storm, plywood and other installations may require contractors working with tools, fasteners, and ladders over a substantial amount of time. These traditional solutions require time, equipment, and manpower that may not be available when a storm takes an unexpected turn. Further, the fasteners required to install plywood over windows may leave screw holes and/or other damage to the outside of the building (e.g., exterior vinyl siding) that would require repair or replacement following the storm.

Moreover, despite the availability of hurricane resistant windows with impact-rated glass, such as is disclosed in U.S. Pat. No. 5,960,606, for example, these products may be too costly for new construction and/or incompatible with existing antique or period window styles. Many states' construction codes do not mandate the use of hurricane windows, so the likelihood that optional impact-rated glass has been installed in a building without a special request is low. Finally, in addition to the increased cost of the storm resistant windows themselves, installation of such features requires further costs associated with adapting the structural framing, brackets, and/or fasteners necessary to support the additional weight and dimensions of storm windows and doors.

U.S. Pat. No. 6,161,605 discloses a folding hinged device with straps configured to fit within the screen tracks of a double-hung window. However, the folds and hinges in the device may allow external positive wind pressure to damage the window, which may lead to further building interior damage. Additionally, the hinged device is constructed out of too many materials, which add weight and are expensive, as well as being more unwieldy to install.

Thus, what is needed is a protection solution for buildings without impact resistant windows that may be easily installed, is cost-effective, and is operative for providing adequate protection from storm or other damage.

BRIEF SUMMARY OF THE DISCLOSURE

According to some aspects of the present disclosure, a protection panel system for resisting external forces includes a protection panel with an outer shell portion formed from a lightweight solid plastic material, and an inner portion formed from a lightweight multi-wall plastic material and configured to fit within or adjacent to the outer shell portion.

In a another aspect, the inner portion of the protection panel may be adhered or affixed to the outer shell portion.

In another aspect, the protection panel system may further include anchoring straps configured to be woven through apertures formed from an exterior face to an interior face of the inner portion of the protection panel and fastened. The anchoring straps may be made of nylon, polyester, plastic, fabric, or rope.

In another aspect, the protection panel system may include fasteners for fastening the anchoring straps, such as a buckle, a hook and loop fastener, a rivet, and a friction hold clasp.

In a further aspect, the outer shell portion of the protection panel may include recesses and/or detents formed in an interior face that are configured to fit the anchoring straps woven through the inner portion of the protection panel.

In a further aspect, the protection panel may be shaped to fit a building opening, such as a double hung, tilt wash window frame. The protection panel may be configured to sit within grooves formed in the building opening In a further aspect, the protection panel may include a peripheral lip that overhangs outside a frame of the building opening and that is configured to be pressed up against the frame to adequately seal the building opening.

In a another aspect, the protection panel may further include sealing material for adequately sealing the building opening.

According to another aspect of the present disclosure, embodiments of the inventive concepts disclosed herein are directed to a method of creating a protection panel. The method may include placing a multi wall polycarbonate panel within a solid polycarbonate shell shaped to fit the multi wall polycarbonate panel, and affixing the solid polycarbonate shell to the multi wall polycarbonate panel.

In a further aspect, the method may include inserting the multi-wall polycarbonate panel within the solid polycarbonate shell into a building opening and fastening the multi-wall polycarbonate panel within the solid polycarbonate shell to an anchor structure for the building opening. The anchor structure for the building opening may be a window sash or a door.

In a further aspect, the method may include forming apertures through the multi-wall polycarbonate panel, and threading straps into and out from the apertures formed through the multi-wall polycarbonate panel. Fastening the multi-wall polycarbonate panel within the solid polycarbonate shell may include fastening the straps around the anchor structure.

In a further aspect, the method may include adding fasteners to the straps after the straps have been threaded into and out from the apertures formed through the multi-wall polycarbonate panel.

In a further aspect, the method may include forming recesses and/or detents within the solid polycarbonate shell, and orienting looped portions of the straps threaded through the multi-wall polycarbonate panel to be aligned with the detents formed within the solid polycarbonate shell when the multi-wall polycarbonate panel is placed within the solid polycarbonate shell.

In a further aspect, the method may include adjusting the straps such that the multi-wall polycarbonate panel within the solid polycarbonate shell is sufficiently pressed against the building opening.

In a further aspect, inserting the multi-wall polycarbonate panel within the solid polycarbonate shell into the building opening may include setting the solid polycarbonate shell within a groove formed in the periphery of the building opening.

In a further aspect, the method may include applying sealing material between the solid polycarbonate shell and the building opening.

In a further aspect, affixing the solid polycarbonate shell to the multi-wall polycarbonate panel may include applying an adhesive layer between the multi-wall polycarbonate panel and the solid polycarbonate shell.

BRIEF DESCRIPTION OF THE DRAWINGS

The present invention is illustrated and described herein with reference to the drawings, in which.

DETAILED DESCRIPTION OF THE DISCLOSURE

Disclosed herein are protection panel systems and methods for securing building openings, such as windows, doors, and other portals that may be vulnerable to external elements and/or wind and debris forces active during storms. The protection panel systems and methods may include a lightweight multi-wall plastic panel housed within a lightweight solid plastic shell, which can be inserted into the building opening to prevent external wind pressures from infiltrating and/or causing damage to the building and its interior contents. The multi-wall plastic panel may include through-holes and/or other apertures for threading anchoring straps. The multi-wall plastic panel threaded with straps may then be inserted and affixed within the solid plastic shell to provide a wind proof exterior face. The multi-wall plastic panel within the solid plastic shell may then be fastened to a window sash, door, and/or other anchoring structure within the building opening using the straps.

The protection panel systems disclosed herein may be low-cost and easily installed into building openings by homeowners themselves from any floor, without requiring outside contractors, ladders, fasteners, or tools. The protection panel systems may fit into existing screen or other tracks in the building opening. In some embodiments the protection panel systems may provide protection against unwanted entry.

In some embodiments, the protection panel system may include a lightweight panel made from a clear polycarbonate plastic. Example protection panels may weigh about 1.25 lbs/sqft. Polycarbonates may be strong, durable, temperature resistant, impact resistant, and/or optically transparent, depending on the grade. Example protection panel systems may be clear with about 76% light transmission. Additionally, polycarbonates are non-conductive and have a high plasticity, so are not prone to breakage. Polycarbonate may be extruded into multi-wall sheets. A coating, film, laminate, and/or stabilizers may be added to the polycarbonate to improve scratch resistance and/or add UV protection. Other suitable (and similar) materials may, of course, be used equally.

The protection panel may include both multi-wall polycarbonate and solid polycarbonate portions. In this way, the protection panel may provide the added strength of multi-wall sheets while being housed in a solid polycarbonate shell portion that is sufficiently wind-proof.

Figure 1:
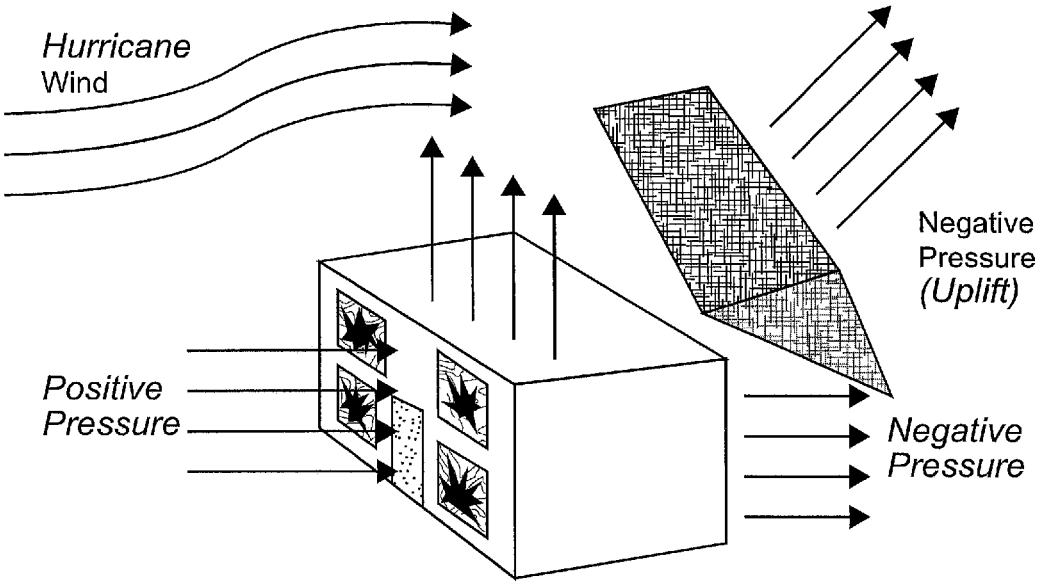
FIG. 1 is a diagram of an example storm damaging unprotected building openings, in accordance with some embodiments of the present disclosure.
Figure 2:
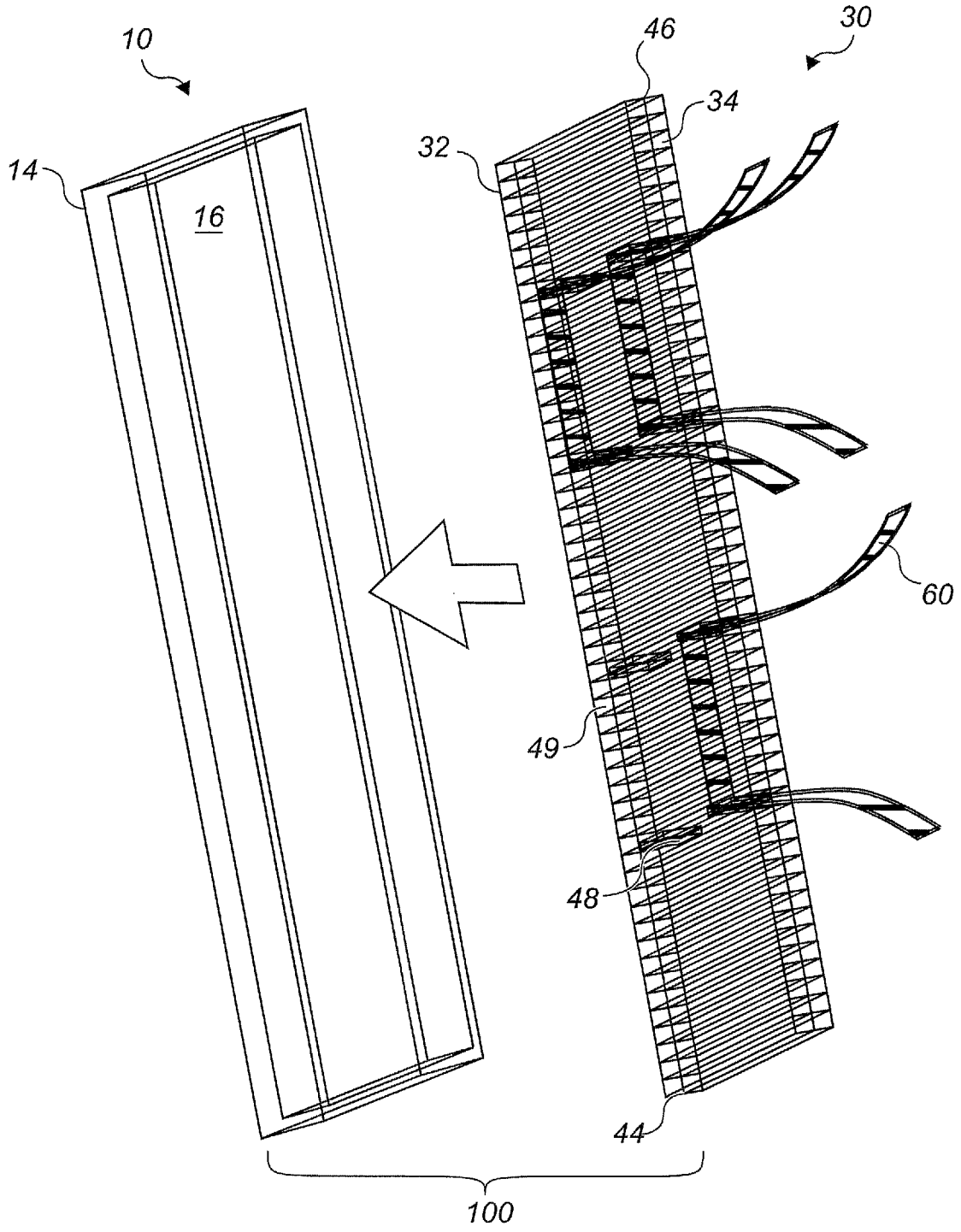
FIG. 2 is a perspective view of an example protection panel being assembled by combining a multi-wall plastic portion including straps with a solid plastic shell portion, in accordance with some embodiments of the present disclosure.
Figure 3:
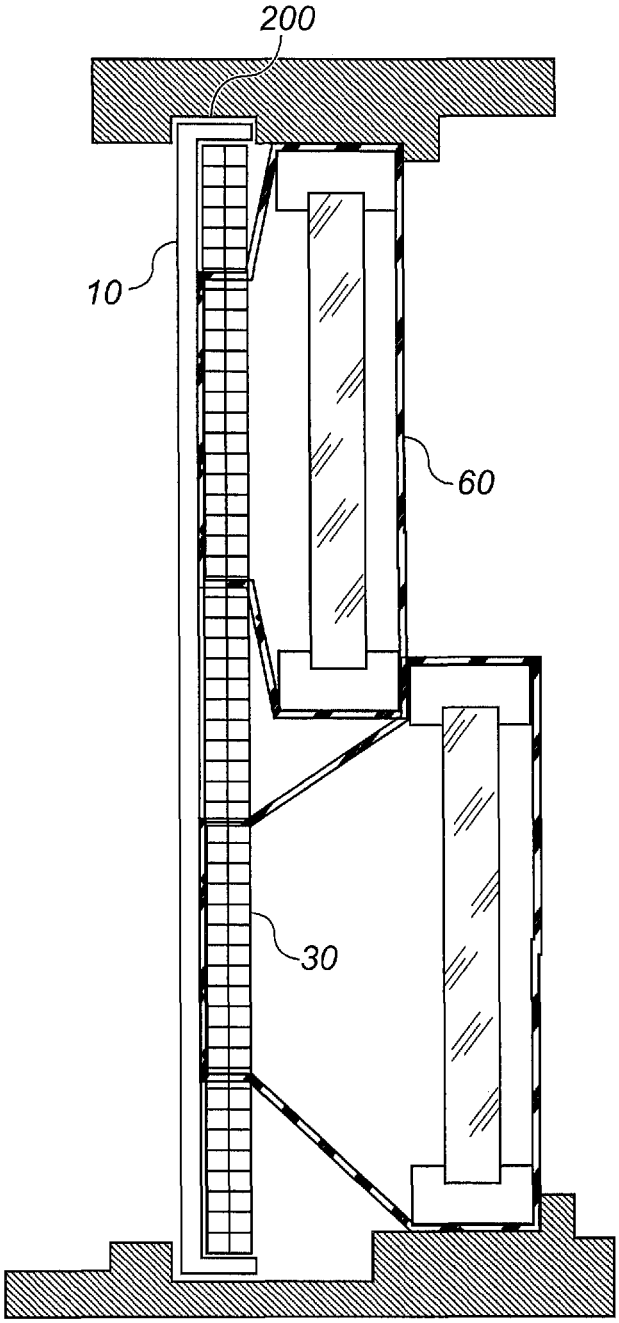
FIG. 3 is a sectional side view of an example protection pane installed in a double-hung window with straps anchored around upper and lower window sashes, in accordance with some embodiments of the present disclosure.

As shown in FIG. 2, a protection panel system 100 may include a protection panel that includes a solid plastic shell portion 10 and a multi-wall plastic portion 30. Some embodiments of the protection panel may be about 36" wide by about 56" tall, for example. The solid plastic shell portion 10 may include a top sidewall, a bottom sidewall, and two opposing sidewalls. The opposing sidewalls may extend between the top sidewall and the bottom sidewall. All of the sidewalls of the solid plastic shell portion may extend perpendicularly from a solid front pane.

The solid plastic shell portion 10 may include a rectangular solid front pane with an exterior surface 14, and an interior surface 16. The multi-wall plastic portion 30 of the protection pane may be configured to be received conformally within the solid plastic shell portion 10. The multi-wall plastic portion 30 may further be sized to allow for expansion and contraction when placed within the solid plastic shell portion 10. The multi-wall plastic portion 30 may include an exterior surface 32 and an interior surface 34.

Polycarbonate is commercially available from multiple manufacturers, and may be advantageously transparent to allow light to enter the building. The solid plastic shell portion 10 may be rigid polycarbonate of about ⅛" or 4 mm thickness, although other thicknesses may be employed. In some embodiments, the solid plastic shell portion 10 may be configured to be received in an outermost groove of a double-hung, tilt-wash window frame. The multi-wall plastic portion 30 may be about ⅝" or 16 mm thick, although other thicknesses may be employed. The multi-wall plastic portion 30 may be commercially available from multiple manufacturers, and may also be transparent, just as the solid plastic shell portion 10, to allow light to enter through the building opening. It will be readily apparent to those of ordinary skill in the art that other materials may be used equally, whether transparent or not, provided the materials provide sufficient strength and durability, including impact resistance. In some embodiments, it may be preferred that the material(s) used are opaque.

In example experiments, solid polycarbonate panels about ⅛" thick tested as too flimsy on their own to withstand strong winds, debris, or other external projectiles. Thus, the multi-wall plastic portion 30 may add to the structural integrity of the protection panel. Combining the solid plastic shell portion 10 with the multi-wall plastic portion 30 provides greater advantages than each portion provided on its own. These components may be separate or integrally formed.

In addition to the increased strength, another example of these advantages stemming from the combination of the solid plastic shell portion 10 with the multi-wall plastic portion 30 is the sealing and wind-proofing effect that results from the solid plastic shell portion 10 covering any holes, bores, apertures, and/or open channels formed through any of the back- and front-facing exterior and interior surfaces and/or either side edge. In particular, despite any open air through-channels extending across the width of the multi-wall plastic portion 30 from one side edge 44 to the opposite edge 46 due to its multi-walled structure, the sidewalls of the solid plastic shell portion 10 advantageously protect the open channels 49 of the multi-wall plastic portion 30 from wind, water, dirt, and other external elements. In addition to the increased stiffness provided by the multiple-walled structures of the multi-wall plastic portion 30, having sealed pockets of air or other insulating material in the open channels 49 of the multi-wall plastic portion 30 may also help insulate the building's interior. It should further be noted that either panel 10,30 can include a lip, ridge or bead around all or a portion of an interior and/or exterior periphery thereof to enhance the strength of the panel 10,30 and effectively help transfer forces to/from the associated window, door, or portal frame in which the panels 10,30 are ultimately disposed.

Additionally, the multi-wall plastic portion 30 may include through-holes or apertures 48 formed from the exterior side 32 through to the interior side 34. In some embodiments, the size and location of the apertures may vary depending on the size of the building opening sought to be protected. The multi-wall plastic portion 30 may be multi-wall polycarbonate, such as a three-wall design and/or other multi-wall polycarbonate sheets. In addition to the three or more vertical walls of the multi-wall plastic portion 30, the multiple interior/exterior-facing vertical walls are interconnected with floor/ceiling-facing horizontal walls spaced throughout the height of the multi-wall plastic portion 30. The rigid interconnections between the multiple walls of the multi-wall plastic portion 30 provide excellent resistance, strength, and resiliency to the protection panel. Some embodiments may additionally include lateral side-facing vertical walls for even greater strength and/or insulating properties. The multi-wall plastic portion 30 may be formed through extrusion, 3D-printing, adhesion, and/or other manufacturing processes, for example.

The solid plastic shell portion 10 may include recesses and/or detents (not shown) formed in the interior surface 16 of the solid plastic shell portion 10, configured to receive the strap portions looped through on the exterior side of the multi-wall plastic portion. The recesses and/or detents may be about 1/32" deep, for example, in order to leave enough space for the straps such that the interior surface of the solid plastic shell portion 10 and the exterior side of the multi-wall plastic portion may be in close contact. This may ensure that air pockets or other internal pressures caused by interruptions to the combined/sealed multi-wall and solid panels are eliminated or minimized, thus preserving the protection panel's integrity and strength.

After placing the multi-wall plastic portion 30 of the protection panel within the solid plastic shell portion 10, the multi-wall plastic portion 30 and solid plastic shell portion 10 may be affixed together. For example, the solid plastic shell portion 10 and/or multi-wall plastic portion 30 may include snap fittings that engage when the two portions are assembled. Other methods of affixation, such as fasteners and/or adhesives, for example, are possible. In some embodiments, the protection panel system may include sealing the protection panel to a building opening. Sealing materials such as very fast set clear water-thin solvent cement may be utilized to form a seal between the protection panel and another structure.

In some embodiments, the multi-wall plastic portion 30 may be affixed to the solid plastic shell portion 10, using two-sided pressure-sensitive adhesive material with protective paper or release sheets, for example. To assembly the protection panel system 100, once the portions of adhesive material and protective paper are removed, straps 60 may be inserted through the slotted apertures 48 from the interior side 34 of the multi-wall plastic portion 30. Then, further portions of the protective paper located directly beneath the middle portion of the strap may be removed, exposing the second side of adhesive material, and the middle portions of the straps 60 may be adhered to the second side of adhesive material. Next, the remaining portion of protective paper may be removed, and the second side of the adhesive material may allow the exterior surface 32 of the multi-wall plastic portion 30 to adhere to the interior surface 16 of the solid plastic shell portion 10. The two-sided adhesive material may be commercially available from 3M (product number 468MP-5 mil), for example, although other two-sided adhesive materials may be used.

As shown in FIG. 2, the straps 60 may extend outwardly from the interior surface 34 of the multi-wall plastic portion 30, having been looped through from the exterior surface 32 through the corresponding slotted apertures 48. The straps 60 may include a buckle, a hook and loop fastener, a rivet, a friction hold clasp, and/or any other suitable fastening device for fastening or tightening the straps 60. In some embodiments, the straps 60 may also include a middle strap portion and a free end that couples with the buckle. The straps 60 may have a thickness of about 1/32", and/or may correspond with the detents formed in the interior surface of the solid plastic shell portion 10. In some embodiments, the straps may be about 6' long. The straps 60 may be formed of polyester, and may be commercially available from various manufacturers. For example, the straps 60 may have seat belt weave webbing and a width of about 1½". The buckles may be formed of plastic, such as plastic cam buckles, for example. Advantageously, having two buckled straps 60 on an upper sash and a lower sash of a double-hung window may reduce the potential for breaking the lock (or locks) on a window, as no pressure is exerted on the window locking system when tightening the straps 60 about the respective sashes after installing the protection panel system 100.

Once the protection panel system 100 is assembled, it may be placed into a building opening, such as in the outermost groove 200 of a window, for example. For window installations, the screens may be first removed from the groove adjacent the window, the upper sash lowered, and the lower sash raised up almost all the way so the protection panel system 100 may be tilted and maneuvered outside the window frame and placed into the groove that previously held the screen. The upper straps may be threaded through the opening of the top sash to hang in the interior of the home, and the top sash may be closed to prevent the protection panel system 100 from falling. Next, the bottom straps may be pulled through the opening of the bottom sash and allowed to hang in the interior of the building. Before closing the bottom sash, the top of the bottom sash may be tilted such that the straps for the upper and lower sashes may be brought inside and placed under the corresponding top sash and above the corresponding bottom sash. Thereafter, the bottom sash may be tilted back into the window frame and locked into place. Each of the straps may then be tightened and fastened together so the protection panel system 100 is tightly maintained in the screen tracks. The straps on the top sash may be pulled upward and the straps on the bottom may be pulled downward so there is no pressure exerted on the locking system of the window which prevents potential damage to the window. The buckles or other fasteners of the straps 60 may be centrally-located with respect to each sash.

Figure 4:
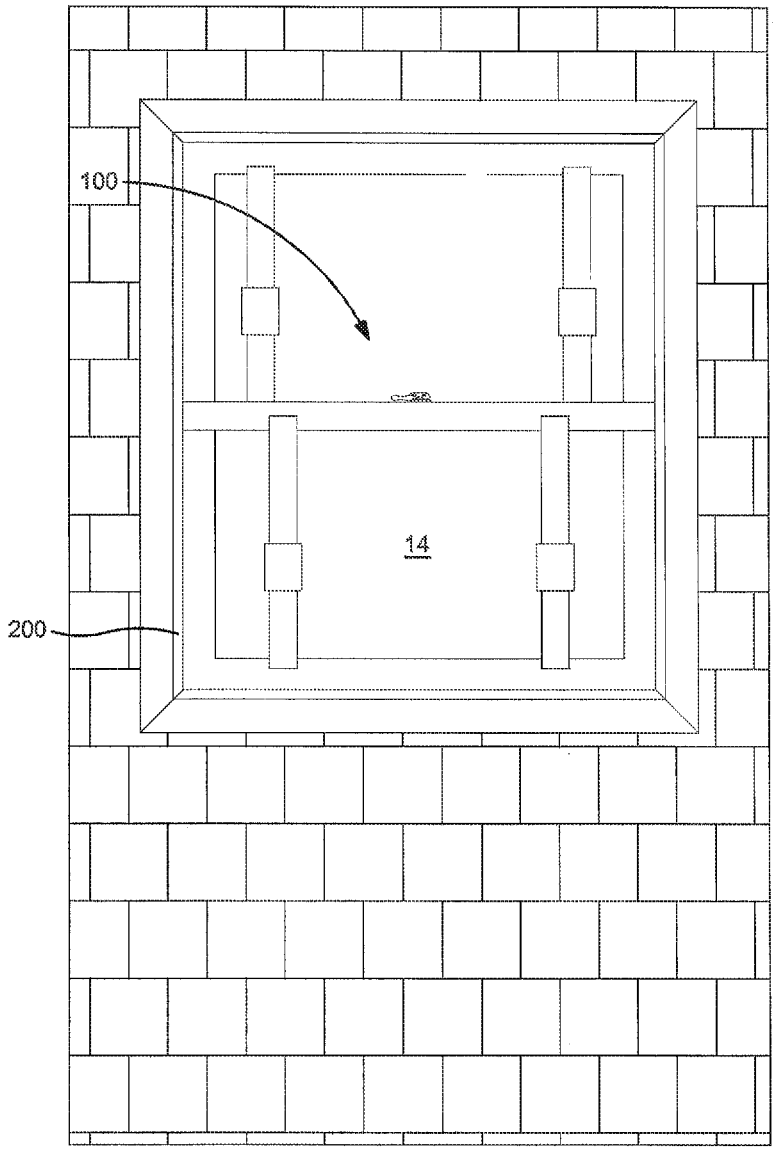
FIG. 4 is an exterior building view of an example protection panel installed in a window, in accordance with some embodiments of the present disclosure.
Figure 5:
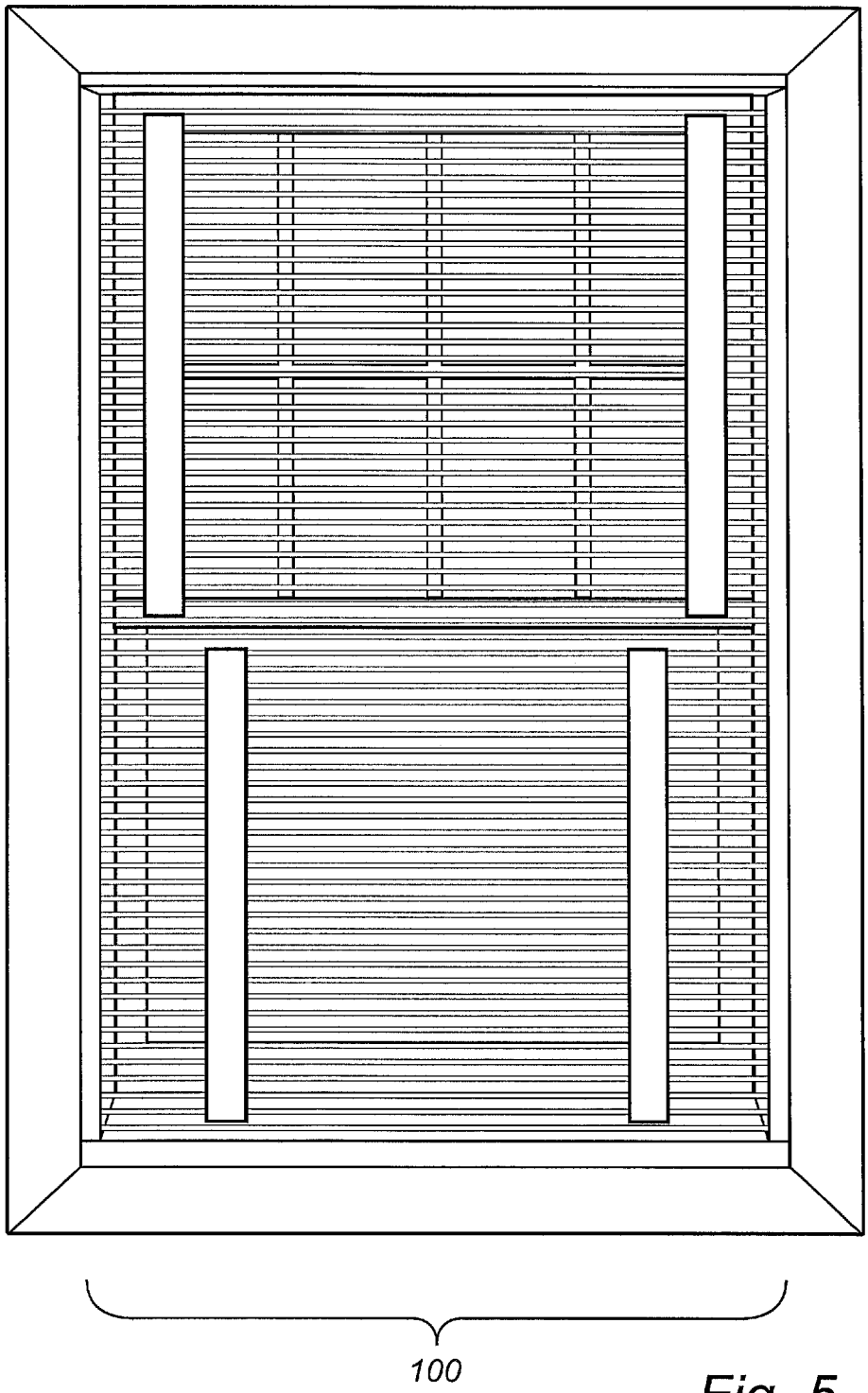
FIG. 5 is a photograph of an example protection panel in use, in accordance with some embodiments of the present disclosure.

As shown in FIG. 4, the protection panel system 100 may be disposed in the outermost groove of a double-hung, tilt-wash window frame, as would be viewed from the outside of a building. FIG. 5 shows a photograph of an installed protection panel system within a window frame. It should be understood that various embodiments of the protection panel system may be configured to fit outside of windows, doors, skylights, chimneys, mail slots, and any other building opening.

Figure 6:
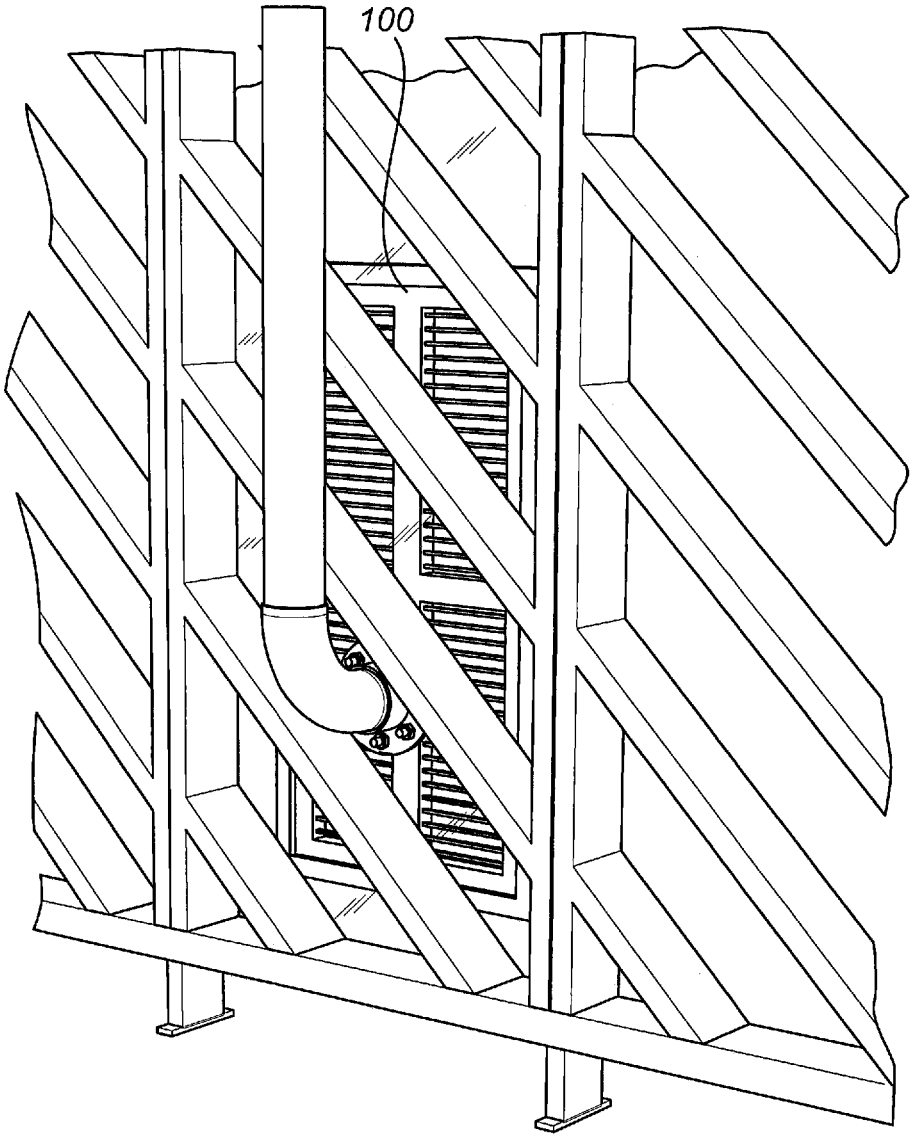
FIG. 6 is a photograph of an example protection panel during wind testing, in accordance with some embodiments of the present disclosure.

FIG. 6 shows a protection panel system 100 during wind testing. During testing, example protection panels withstood uniform positive and negative structural load tests (e.g., Uniform Load Structural Performance Test ASTM E330-14) of about 57.6 pounds per square foot (equivalent to about 150 mph) without cracking, breaking, or dissociation of any kind.

The protection panel system may have an R value of about 2.5 in addition to window or other insulation. The protection panel system may have rated sound insulation with sound reduction of about 21 dB. The protection panel system may have impact resistance in temperatures ranging from about −40° F. to about 248° F.

Additionally or alternatively, the multi-wall plastic portion 30 may include apertures or slots for anchoring straps formed through the internal walls, such that the exterior surface of the multi-wall plastic portion 30 remains solid. This may allow the exterior surface of the multi-wall plastic portion 30 to be completely adhered and/or sealed to the solid plastic shell portion 10. In some embodiments, holes may be bored in multiple directions through the internal walls and the interior surface of the multi-wall plastic portion 30, and anchoring straps or ropes may be threaded through the route drilled or integrally formed, such as through 3D or additive printing, for example.

Figure 7:
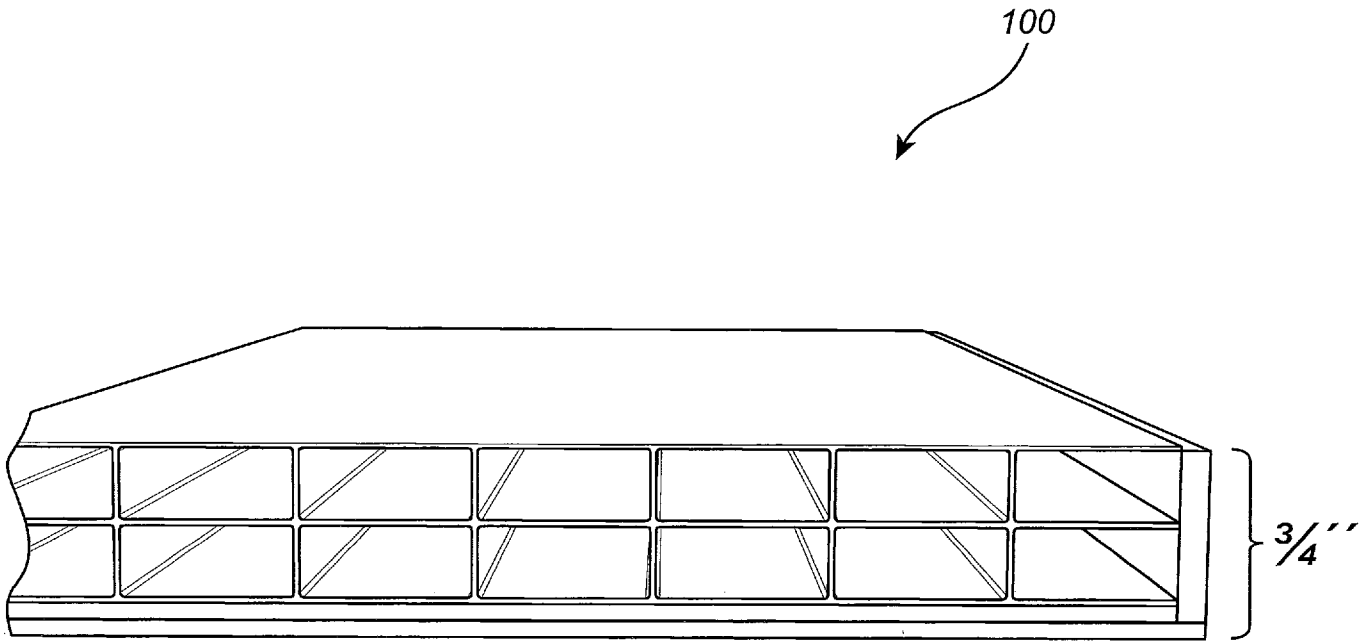
FIG. 7 is a photograph of an example protection panel as viewed from the side edge showing a combined solid polycarbonate shell and multi-wall polycarbonate insert, in accordance with some embodiments of the present disclosure.

FIG. 7 illustrates how the protection panel may be formed from the multi wall plastic portion sitting within and sealed against the solid plastic shell portion. The overall thickness of the protection panel may be about ¾".

In some embodiments, the thickness and strength of the combined solid and multi-wall polycarbonate panels may act as a debris and/or projectile defense system. For example, the protection panel may be bullet-proof to a certain rating. The thickness and/or wall structure of the protection panel may be altered to adjust for custom projectile or force resistance needs.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are contemplated thereby.

What is claimed is:

1. A protection panel system for resisting external forces applied to a window, door, or other portal of a structure, the system comprising:

a protection panel, the protection panel comprising:

an outer shell portion formed from a solid plastic material, and an inner portion formed from a multi-wall plastic material and configured to fit within or be coupled to the outer shell portion; and anchoring straps configured to be woven only through apertures formed from an exterior face to an interior face of the inner portion of the protection panel and fastened, wherein the anchoring straps are partially disposed and traverse a space between an interior surface of the outer shell portion and an exterior surface of the inner portion.

2. The protection panel system of claim 1, wherein the inner portion is adhered to the outer shell portion.

3. The protection panel system of claim 1, wherein the protection panel is shaped to fit a building opening.

4. The protection panel system of claim 1, further comprising:

fasteners for fastening the anchoring straps.

5. The protection panel system of claim 3, wherein the protection panel is configured to sit within grooves formed in the building opening.

6. The protection panel system of claim 3, wherein the building opening is a double-hung, tilt-wash window frame.

7. The protection panel system of claim 3, wherein the protection panel includes a peripheral lip that overhangs outside a frame of the building opening and that is configured to be pressed up against the frame to adequately seal the building opening.

8. The protection panel system of claim 3, wherein the protection panel further includes sealing material for adequately sealing the building opening.

9. The protection panel system of claim 1, wherein one or more or the outer shell portion and the inner portion of the protection panel comprises a lip structure disposed about a periphery thereof.

10. A method of creating a protection panel, the method comprising:

disposing a multi-wall polycarbonate panel within or adjacent to a solid polycarbonate shell shaped to fit the multi-wall polycarbonate panel; and affixing the solid polycarbonate shell to the multi-wall polycarbonate panel, wherein the multi-wall polycarbonate panel within or adjacent to the solid polycarbonate shell is adapted to be inserted into a building opening;

providing means for fastening the multi-wall polycarbonate panel within or adjacent to the solid polycarbonate shell to an anchor structure for the building opening forming apertures through the multi-wall polycarbonate panel; and threading straps only into and out from the apertures formed through the multi-wall polycarbonate panel, wherein the straps are partially disposed and traverse a space between an interior surface of the solid polycarbonate shell and an exterior surface of the multi-wall polycarbonate panel wherein the means for fastening the multi-wall polycarbonate panel within the solid polycarbonate shell includes means for fastening the straps around the anchor structure.

11. The method of claim 10, further comprising:

adjusting the straps such that the multi-wall polycarbonate panel within the solid polycarbonate shell is sufficiently pressed against the building opening.

12. The method of claim 10, wherein the anchor structure for the building opening is one of a window sash and a door.

13. The method of claim 10, wherein inserting the multi-wall polycarbonate panel within the solid polycarbonate shell into the building opening includes setting the solid polycarbonate shell within a groove formed in the periphery of the building opening.

14. The method of claim 10, further comprising:

applying sealing material between the solid polycarbonate shell and the building opening.

15. The method of claim 10, wherein affixing the solid polycarbonate shell to the multi-wall polycarbonate panel includes applying an adhesive layer between the multi-wall polycarbonate panel and the solid polycarbonate shell.

* * * * *